US008378739B2

(12) United States Patent
Notani et al.

(10) Patent No.: US 8,378,739 B2
(45) Date of Patent: Feb. 19, 2013

(54) SEMICONDUCTOR CHIP

(75) Inventors: Hiromi Notani, Kanagawa (JP); Issei Kashima, Kanagawa (JP)

(73) Assignee: Renesas Electronics Corporation, Kawasaki-Shi (JP)

( * ) Notice: Subject to any disclaimer, the term of this patent is extended or adjusted under 35 U.S.C. 154(b) by 32 days.

(21) Appl. No.: 13/184,030

(22) Filed: Jul. 15, 2011

(65) Prior Publication Data

US 2012/0049899 A1 Mar. 1, 2012

(30) Foreign Application Priority Data

Aug. 26, 2010 (JP) ..... 2010-189352

(51) Int. Cl.
*G05F 1/10* (2006.01)

(52) U.S. Cl. ..... 327/540; 327/538

(58) Field of Classification Search ..... 327/540
See application file for complete search history.

(56) References Cited

U.S. PATENT DOCUMENTS 5,319,302 A * 6/1994 Koshikawa et al. ..... 323/273
6,114,843 A * 9/2000 Olah ..... 323/280
6,201,380 B1 * 3/2001 Tsujino et al. ..... 323/313
6,429,729 B2 * 8/2002 Kobayashi et al. ..... 327/540
6,515,461 B2 * 2/2003 Akiyama et al. ..... 323/313
6,667,603 B2 12/2003 Hiraki et al.
6,774,712 B2 * 8/2004 Rhee et al. ..... 327/540
7,049,797 B2 * 5/2006 Fukui et al. ..... 323/281
7,126,872 B2 * 10/2006 Fukui et al. ..... 365/226
7,250,811 B2 * 7/2007 Kim ..... 327/538
7,986,180 B2 * 7/2011 Lee et al. ..... 327/540
8,125,431 B2 * 2/2012 Kimura et al. ..... 345/95
2002/0003449 A1 * 1/2002 Kato ..... 327/540
2012/0229202 A1 * 9/2012 Nikolov et al. ..... 327/564

FOREIGN PATENT DOCUMENTS

JP 2001-211640 8/2001

* cited by examiner

*Primary Examiner* — Thomas J Hiltunen
(74) *Attorney, Agent, or Firm* — McDermott Will & Emery LLP

(57) ABSTRACT

The present invention provides a semiconductor chip which is insusceptible to noise and whose consumption current is small. In a semiconductor chip, an internal power supply voltage for an internal circuit block is generated by a regulator having small current drive capability and a regulator having large current drive capability. A voltage buffer is provided between a reference voltage generating circuit and the regulator having large current drive capability. In a low-speed operation mode, the voltage buffer and the regulator having large current drive capability are made inactive. Therefore, noise in reference voltage is suppressed, and consumption current can be reduced.

7 Claims, 10 Drawing Sheets

SEMICONDUCTOR CHIP

CROSS-REFERENCE TO RELATED APPLICATIONS

The disclosure of Japanese Patent Application No. 2010-189352 filed on Aug. 26, 2010 including the specification, drawings and abstract is incorporated herein by reference in its entirety.

BACKGROUND

The present invention relates to a semiconductor chip and, more particularly, to a semiconductor chip having first and second operation modes of different consumption currents.

There is a semiconductor chip having a first operation mode in which first current is consumed and a second operation mode in which second current larger than the first current is consumed (refer to, for example, Japanese Unexamined Patent Publication No. 2001-211640).

The semiconductor chip has a reference voltage generating circuit for generating reference voltage, first and second regulators for generating power supply voltage on the basis of the reference voltage, and an internal circuit which is driven by the power supply voltage generated by the first and second regulators and executes first and second operation modes.

The first regulator has first current drive capability, and the second regulator has second current drive capability higher than the first current drive capability. In the first and second operation modes, the first and second regulators are activated, respectively, thereby reducing the consumption current.

SUMMARY

The semiconductor chip in the related art, however, has a problem such that voltage drop (current drop) occurs in a power supply line between the second regulator and the internal circuit, and the power supply voltage decreases. As a countermeasure, there is a method of shortening the power supply line by disposing the second regulator apart from the reference voltage generating circuit and close to the internal circuit.

In the method, however, the line between the reference voltage generating circuit and the second regulator becomes long and noise occurs in the reference voltage. When the current drive capability of the reference voltage generating circuit is increased, noise in the reference voltage can be suppressed but consumption current increases.

A main object of the present invention is therefore to provide a semiconductor chip which is insusceptible to noise and whose consumption current is small.

The present invention relates to a semiconductor chip having a first operation mode in which first current is consumed and a second operation mode in which second current larger than the first current is consumed, including: a reference voltage generating circuit for generating a first reference voltage; a first regulator having first current drive capability and generating a power supply voltage on the basis of the first reference voltage; a voltage buffer for generating a second reference voltage of a level according to the first reference voltage; a second regulator having second current drive capability higher than the first current drive capability and generating the power supply voltage on the basis of the second reference voltage; and an internal circuit which is driven by the power supply voltage generated by the first and second regulators and executes the first and second operation modes. The first regulator and the voltage buffer are provided near the reference voltage generating circuit, and the second regulator is provided near the internal circuit. The voltage buffer and the second regulator are made inactive in the first operation mode.

In the semiconductor chip according to the present invention, the voltage buffer is provided between the reference voltage generating circuit and the second regulator. In the first operation mode, the voltage buffer and the second regulator are made inactive. Therefore, noise in the reference voltage is suppressed, and the consumption current can be reduced.

DETAILED DESCRIPTION

A semiconductor chip of an embodiment has an on-chip power supply which generates an internal power supply voltage VDD on the basis of an external power supply voltage VCC. The semiconductor chip has a high-speed operation mode in which it operates at high speed (for example, 50 MHz) and a low-speed operation mode in which it operates at low speed (for example, 32 KHz). The consumption current in the high-speed operation mode is larger than that in the low-speed operation mode.

Figure 1:
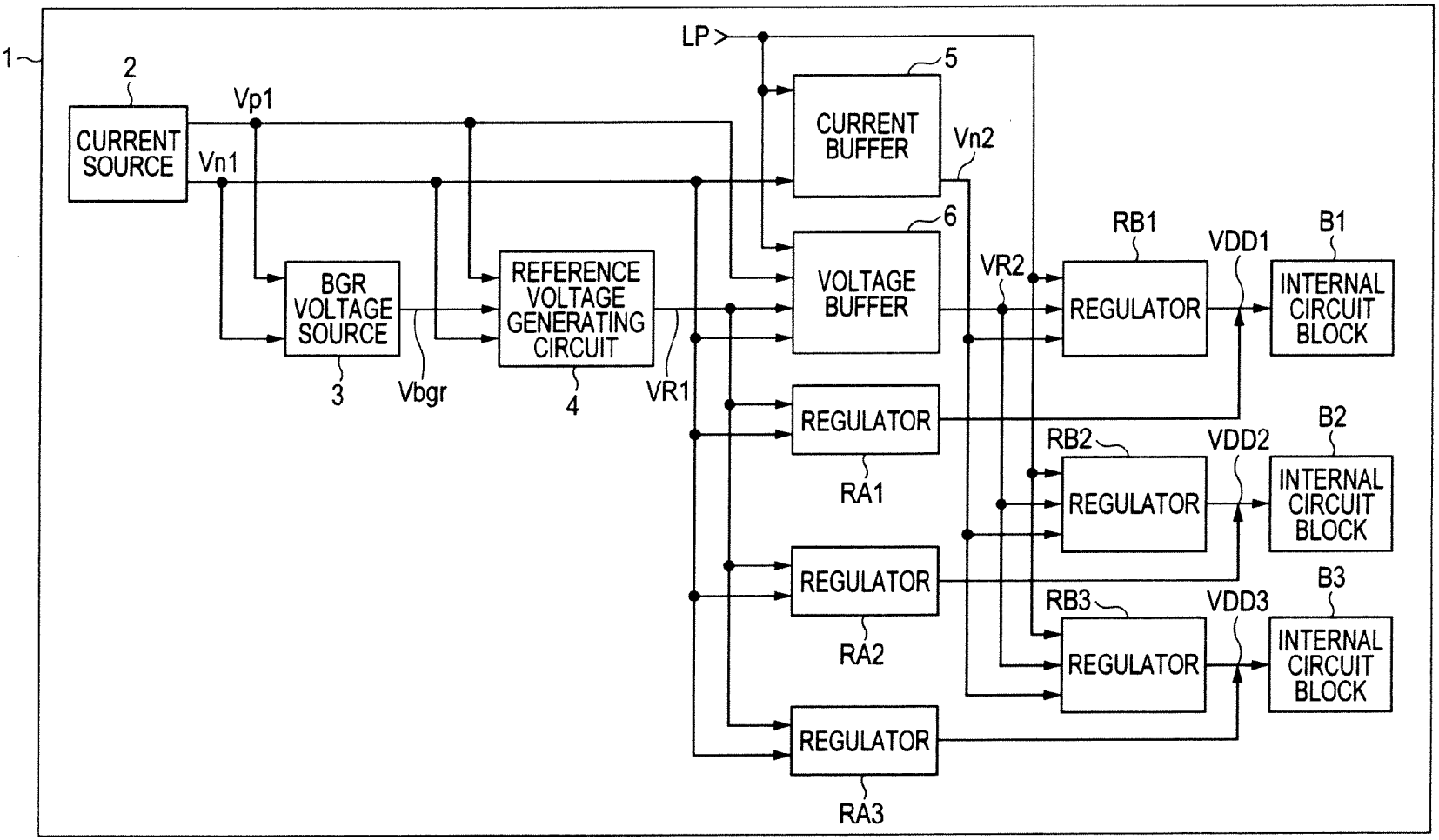
FIG. 1 is a block diagram showing the configuration of a semiconductor chip according to an embodiment of the present invention.

As shown in FIG. 1, the semiconductor chip has a semiconductor substrate 1 having a square shape. On the surface of the semiconductor substrate 1, a current source 2, a BGR (Band Gap Reference) voltage source 3, a reference voltage generating circuit 4, a current buffer 5, a voltage buffer 6, regulators RA1 to RA3 and RB1 to RB3, and internal circuit blocks B1 to B3 are formed. The BGR voltage source 3, the reference voltage generating circuit 4, and the current buffer 5 are disposed near the current source 2. The voltage buffer 6 and the regulators RA1 to RA3 are disposed near the reference voltage generating circuit 4. The regulators RB1 to RB3 are disposed near the internal circuit blocks B1 to B3.

In the semiconductor chip, in the high-speed operation mode, the regulators RB1 to RB3 mainly supply power to the internal circuit blocks B1 to B3. The regulators RB1 to RB3 operate on the basis of a bias voltage Vn2 from the current buffer 5 and a reference voltage VR2 from the voltage buffer 6. On the other hand, in the low-speed operation mode, the regulators RA1 to RA3 supply power to the internal circuit blocks B1 to B3. The regulators RA1 to RA3 operate on the basis of the bias voltage Vn1 from the current source and the reference voltage VR1 from the reference voltage generating circuit 4. In the low-speed operation mode, the current buffer 5, the voltage buffer 6, and the regulators RB1 to RB3 stop operating.

The current source 2 generates a constant current Ic having small voltage dependence and outputs a bias voltage Vp1 for passing current of a level according to the constant current Ic to P-channel MOS transistors and a bias voltage Vn1 for passing current of a level according to the constant current Ic to N-channel MOS transistors.

Figure 2:
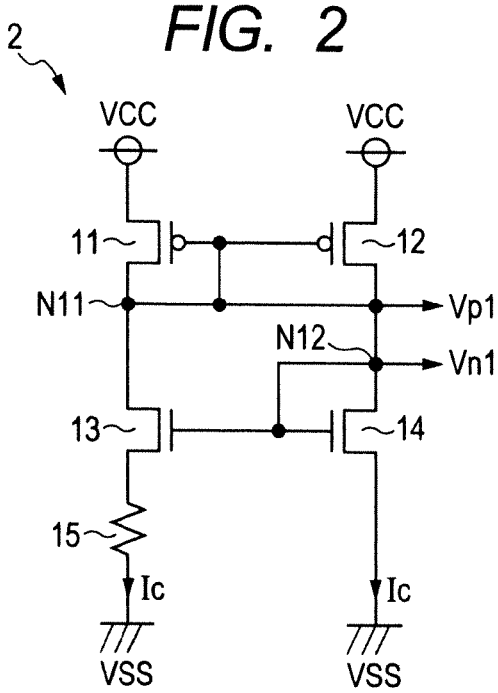
FIG. 2 is a circuit diagram showing the configuration of a current source illustrated in FIG. 1.

As shown in FIG. 2, the current source 2 includes P-channel MOS transistors 11 and 12, N-channel MOS transistors 13 and 14, and a resistive element 15. The transistors 11 and 13 and the resistive element 15 are coupled in series between the line of an external power supply voltage VCC and a line of a ground voltage VSS. The transistors 12 and 14 are coupled in series between the line of the external power supply voltage VCC and the line of the ground voltage VSS. The gates of the transistors 11 and 12 are coupled to the drain (output node N11) of the transistor 11. The gates of the transistors 13 and 14 are coupled to the drain (output node N12) of the transistor 14.

The size of the transistor 11 and that of the transistor 12 are the same, and the current Ic flowing in the current path on the left side and the current Ic flowing in the current path on the right side are equal to each other. The gate length (L size) of the transistor 13 and that of the transistor 14 are the same, and the gate width (W size) of the transistor 13 is larger than that of the transistor 14. By the difference between the gate voltages of the transistors 13 and 14 and the resistance value of the resistive element 15, the value of the constant current Ic of the current source 2 is determined. At the output node N11, the bias voltage Vp1 of the level according to the constant current Ic appears. At the output node N12, the bias voltage Vn1 of the level according to the constant current Ic appears. The output impedance of the current source 2 is equal to the inverse of a transconductor of the transistors 11 to 14.

The BGR voltage source 3 includes a bipolar transistor and a resistive element (not shown), operates on the basis of the bias voltages Vp1 and Vn1, and generates a constant voltage Vbgr (for example, 1.1V) having small temperature dependency and voltage dependency.

Referring again to FIG. 1, the reference voltage generating circuit 4 operates on the basis of the bias voltages Vp1 and Vn1 and generates a reference voltage VR1 (for example, 1.5V) on the basis of the constant voltage Vbgr.

Figure 3:
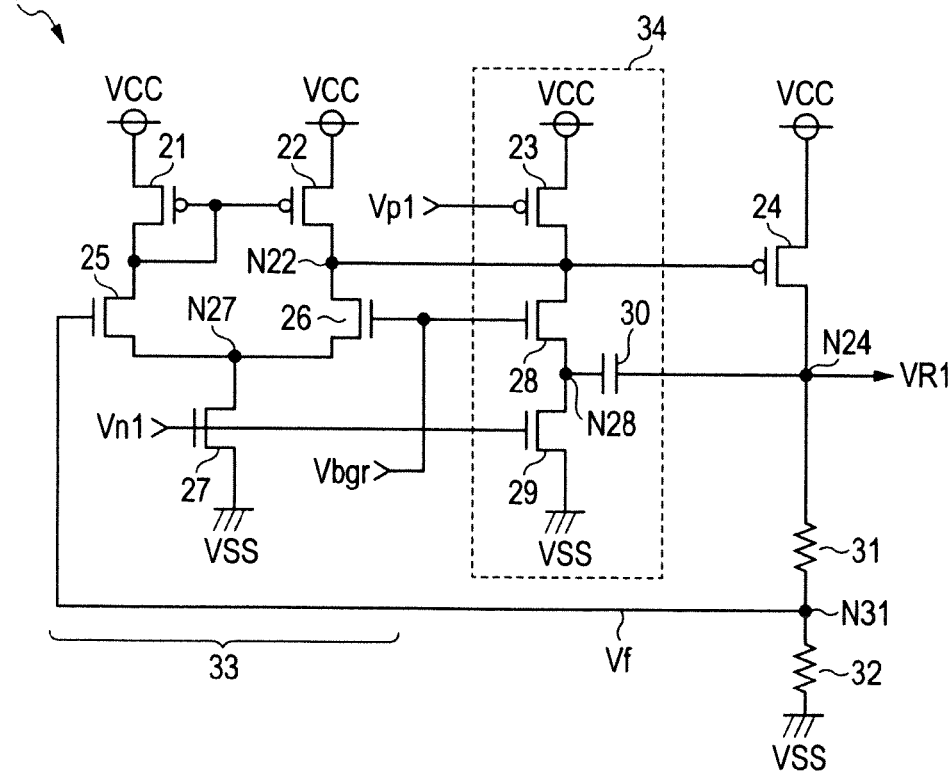
FIG. 3 is a circuit diagram showing the configuration of a reference voltage generating circuit illustrated in FIG. 1.

As shown in FIG. 3, the reference voltage generating circuit 4 includes P-channel MOS transistors 21 to 24, N-channel MOS transistors 25 to 29, a capacitor 30, and resistive elements 31 and 32. The transistors 21, 25, and 27 are coupled in series between the line of the external power supply voltage VCC and the line of the ground voltage VSS. The transistors 22 and 26 are coupled in series between the line of the external power supply voltage VCC and the drain (node N27) of the transistor 27. The gates of the transistors 21 and 22 are coupled to the drain of the transistor 21. The gates of the transistors 25 to 27 receive voltages Vf, Vbgr, and Vn1, respectively.

The transistors 21, 22, and 25 to 27 configure a differential amplifier 33 which compares the voltage Vf and the voltage Vbgr and outputs a signal of a level according to the comparison result to an output node N22 between the transistors 22 and 26. The transistor 27 serves as a constant current supply which passes constant current of the level according to the bias voltage Vn1. Even in the case where the external power supply voltage VCC fluctuates, the current flowing in the transistor 27, that is, drive current for the differential amplifier 33 is maintained constant.

The P-channel MOS transistor 24 as an output transistor is coupled between the line of the external power supply voltage VCC and the output node N24 and its gate receives an output signal of the differential amplifier 33. The resistive elements 31 and 32 are coupled between the output node N24 and the line of the ground voltage VSS. The voltage Vf of the node N31 between the resistive elements 31 and 32 is fed back to the gate of the transistor 25 in the differential amplifier 33.

The differential amplifier 33 controls the transistor 24 so that the voltage Vf coincides with the constant voltage Vbgr. When resistance values of the resistive elements 31 and 32 are set as R1 and R2, the voltage of the output node N24, that is, reference voltage VR1 is maintained at Vbgr×(R1+R2)/R2.

The transistors 23, 28, and 29 are coupled in series between the line of the external power supply voltage VCC and the line of the ground voltage VSS. The gates of the transistors 23, 28, and 29 receive the voltages Vp1, Vbgr, and Vn1, respectively. The drains of the transistors 23 and 28 are coupled to the node N22. The capacitor 30 is coupled between a node N28 between the transistors 28 and 29 and an output node N24. An Ahuja phase compensation circuit 34 for performing phase compensation of the reference voltage generating circuit 4 is configured by the transistors 23, 28, and 29 and the capacitor 30.

Referring again to FIG. 1, a control signal LP is given to each of the current buffer 5, the voltage buffer 6, and the regulators RB1 to RB3. The control signal LP is a signal which is set to the "L" level as an activation level in the high-speed operation mode and is set to the "H" level as an inactive level in the low-speed operation mode.

The current buffer 5 is activated in the case where the control signal LP is at the "L" level and, on the basis of the bias voltage Vn1, generates the bias voltage Vn2 for passing current of the level according to the constant current Ic to the N-channel MOS transistors. The current buffer 5 is made inactive when the control signal LP is at the "H" level.

Figure 4:
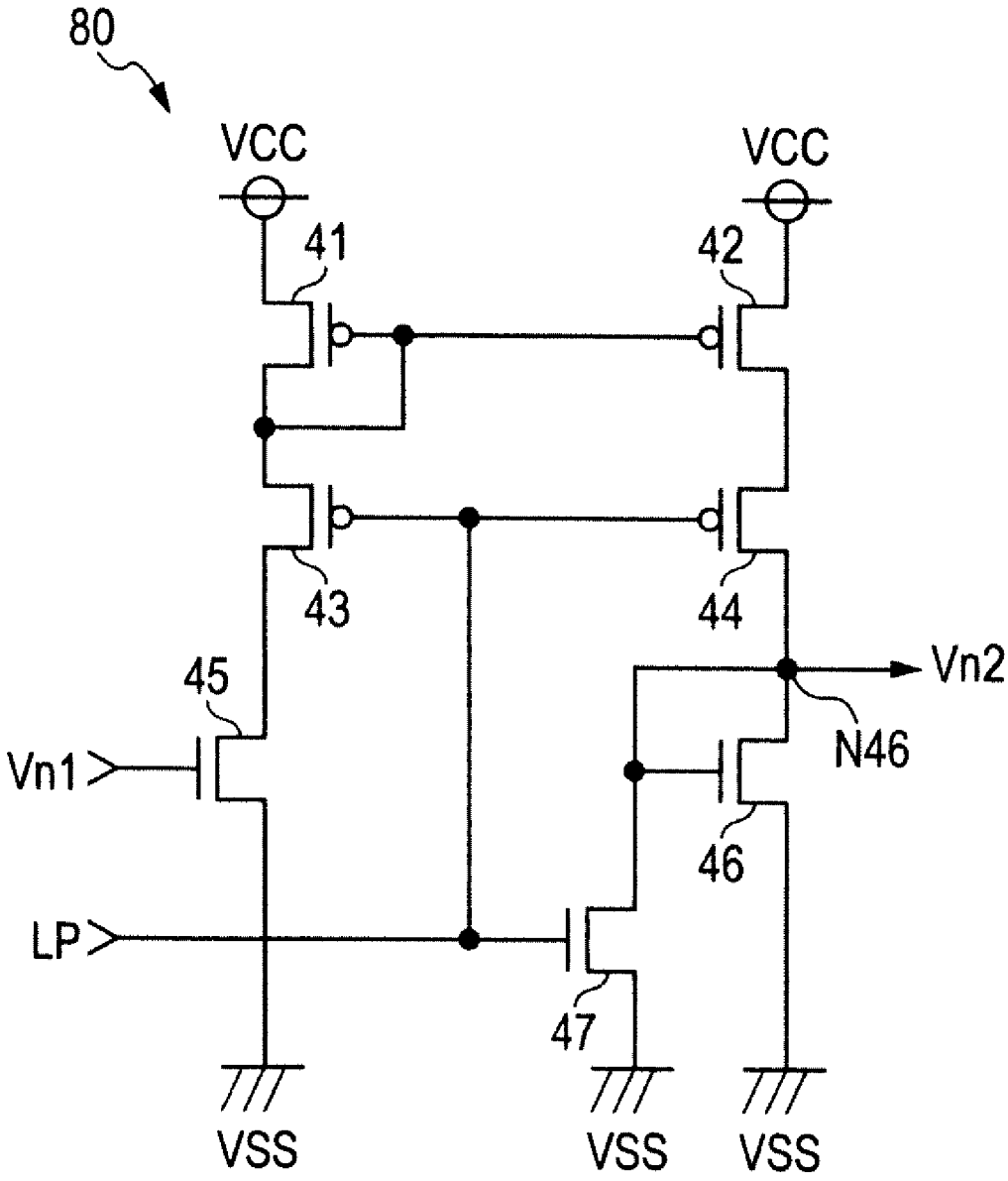
FIG. 4 is a circuit diagram showing the configuration of a current buffer illustrated in FIG. 1.

As shown in FIG. 4, the current buffer 5 includes P-channel MOS transistors 41 to 44 and N-channel MOS transistors 45 to 47. The transistors 41, 43, and 45 are coupled in series between the line of the external power supply voltage VCC and the line of the ground voltage VSS. The transistors 42, 44, and 46 are coupled in series between the line of the external power supply voltage VCC and the line of the ground voltage VSS. The gates of the transistors 41 and 42 are coupled to the drain of the transistor 41. The gate of the transistor 46 is coupled to the drain (an output node N46) of the transistor 46. The transistor 47 is coupled between the output node N46 and the line of the ground voltage VSS. The gates of the transistors 43, 44, and 47 receive the control signal LP. The gate of the transistor 45 receives the bias voltage Vn1. At the output node N46, the bias voltage Vn2 appears.

In the case where the control signal LP is at the "L" level as the activation level, the transistors 43 and 44 are conductive, the transistor 47 is nonconductive, and the current buffer 5 is activated. The transistors 41, 43, and 45 are coupled in series, the transistors 42, 44, and 46 are coupled in series, and the transistors 41 and 42 configure a current mirror circuit, so that a current of the level according to the bias voltage Vn1 flows in the transistors 41 to 46. Therefore, the bias voltage Vn2 becomes a voltage of a level according to the bias voltage Vn1.

In the case where the control signal LP is set to the "H" level as the inactivation level, the transistors 43 and 44 become nonconductive, the transistor 47 becomes conductive, the current flowing from the line of the external power supply voltage VCC to the line of the ground voltage VSS is interrupted, and the bias voltage Vn2 becomes 0V.

A current mirror is configured by the N-channel MOS transistor 14 in the current source 2 and the N-channel MOS transistor 45 in the current buffer 5. When the mirror ratio (transistor size ratio) between the transistors 14 and 45 is set as Sn and the mirror ratio between the transistors 41 and 42 is set as Sp, output current of the current buffer 5 becomes Sn×Sp times of the constant current Ic of the current source 2, and the output impedance of the current buffer 5 becomes 1/(Sn×Sp) times of the output impedance of the current source 2.

Referring again to FIG. 1, when the control signal LP is at the "L" level, the voltage buffer 6 is activated, operates on the basis of the bias voltages Vn1 and Np1, and generates the reference voltage VR2 on the basis of the reference voltage VR1. When the control signal LP is at the "H" level, the voltage buffer 6 is made inactive.

Figure 5:
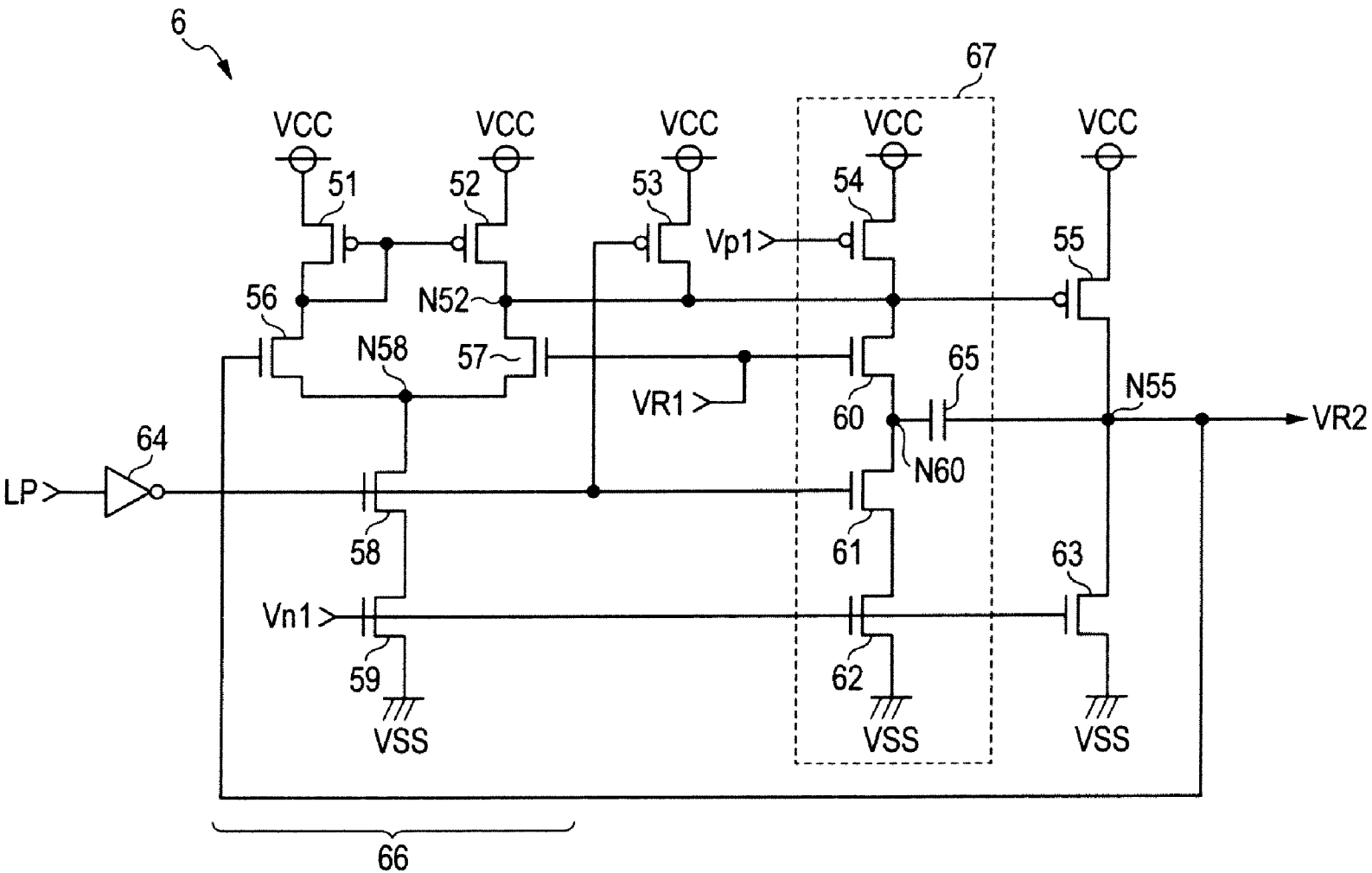
FIG. 5 is a circuit diagram showing the configuration of a voltage buffer illustrated in FIG. 1.

As shown in FIG. 5, the voltage buffer 6 includes P-channel MOS transistors 51 to 55, N-channel MOS transistors 56 to 63, an inverter 64, and a capacitor 65. The control signal LP is inverted by the inverter 64. The transistors 51, 56, 58, and 59 are coupled in series between the line of the external power supply voltage VCC and the line of the ground voltage VSS. The transistors 52 and 57 are coupled in series between the line of the external power supply voltage VCC and the drain (a node N58) of the transistor 58. The gates of the transistors 51 and 52 are coupled to the drain of the transistor 51. The gates of the transistors 56, 57, and 59 receive the voltages VR2, VR1, and Vn1, respectively. The gate of the transistor 58 receives an output signal of the inverter 64.

The transistors 51, 52, and 56 to 59 configure a differential amplifier 66 which is activated in the case where the control signal LP is at the "L" level, compares the voltages VR1 and VR2, and outputs a signal of a level according to the comparison result to an output node N52 between the transistors 52 and 57. The transistor 59 serves as a constant current supply which passes constant current of the level according to the bias voltage Vn1. Even in the case where the external power supply voltage VCC fluctuates, the current flowing in the transistor 59, that is, drive current for the differential amplifier 66 is maintained constant. In the case where the control signal LP is at the "H" level, the transistor 58 becomes nonconductive, and the differential amplifier 66 is made inactive.

The P-channel MOS transistor 53 is coupled between the line of the external power supply voltage VCC and the output node N52 of the differential amplifier 66 and its gate receives an output signal of the inverter 64. In the case where the control signal LP is set to the "H" level as the inactivation level, the transistor 53 becomes conductive, and the output node N52 is fixed at the "H" level. In the case where the control signal LP is at the "L" level as the activation level, the transistor 53 becomes nonconductive.

The P-channel MOS transistor 55 as an output transistor is coupled between the line of the external power supply voltage VCC and an output node N55, and its gate receives an output signal of the differential amplifier 66. The N-channel MOS transistor 63 is coupled between an output node N55 and the line of the ground voltage VSS, and its gate receives the bias voltage Vn1. The transistor 63 passes current of a level according to the constant current Ic from the output node N55 to the line of the ground voltage VSS. The voltage VR2 at the output node N55 is fed back to the gate of the transistor 56 of the differential amplifier 66.

In the case where the control signal LP is at the "L" level as the activation level, the differential amplifier 66 controls the transistor 55 so that the reference voltage VR2 coincides with the reference voltage VR1. As a result, the reference voltage VR2 is maintained at the reference voltage VR1. In the case where the control signal LP is at the "H" level as the inactivation level, the transistor 55 is fixed in the nonconductive state, the output node N55 is coupled to the line of the ground voltage VSS via the transistor 63 as the constant current source, and the reference voltage VR2 drops to the ground voltage VSS.

The transistors 54 and 60 to 62 are coupled in series between the line of the external power supply voltage VCC and the line of the ground voltage VSS. The gates of the transistors 54, 60, and 62 receive the voltages Vp1, VR1, and Vn1, respectively. The gate of the transistor 61 receives an output signal of the inverter 64. The drains of the transistors 54 and 60 are coupled to the output node N52. The capacitor 65 is coupled between a node N60 between the transistors 60 and 61 and the node N55. An Ahuja phase compensation circuit 67 for performing phase compensation of the voltage buffer 6 is configured by the transistors 54, 60, 61, and 62 and the capacitor 65.

In the case where the control signal LP is at the "L" level as the activation level, the transistor 61 is conducted, and the Ahuja phase compensation circuit 67 is activated. In the case where the control signal LP is at the "H" level as the inactivation level, the transistor 61 becomes nonconductive, and the Ahuja phase compensation circuit 67 becomes inactive.

Referring to FIG. 1, the regulators RA1 to RA3 operate on the basis of the bias voltage Vn1 and generate internal power supply voltages VDD1 to VDD3 on the basis of the reference voltage VR1. The regulators RA1 to RA3 are always active. The current drive capability (maximum output current) of the regulators RA1 to RA3 is smaller than the current drive capability of the regulators RB1 to RB3.

Figure 6:
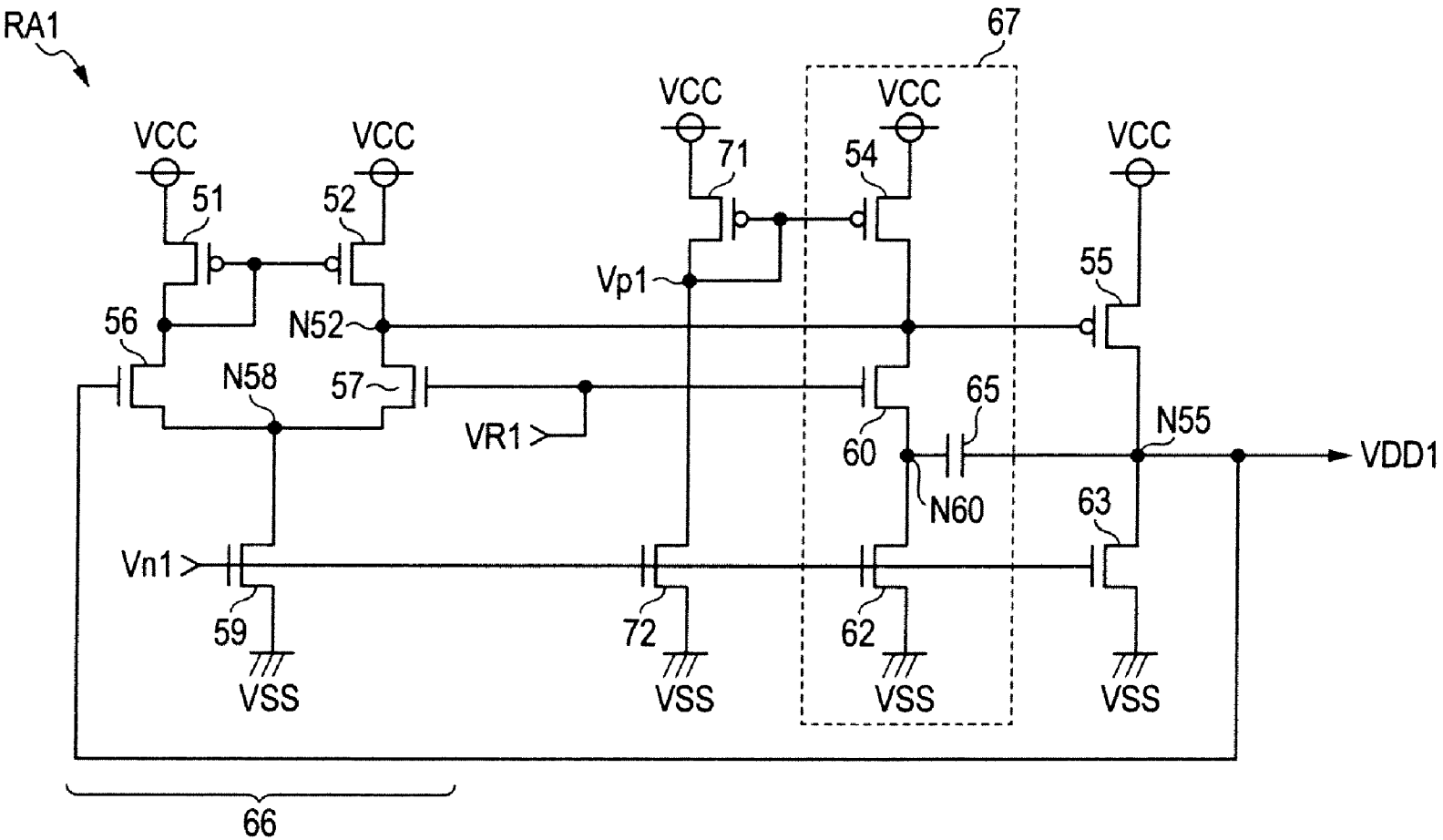
FIG. 6 is a circuit diagram showing the configuration of a regulator RA1 illustrated in FIG. 1.

FIG. 6 is a circuit diagram showing the configuration of the regulator RA1, which is compared to FIG. 5. Referring to FIG. 6, the regulator RA1 is different from the voltage buffer 6 of FIG. 5 with respect to the points that the transistors 53, 58, and 61 and the inverter 64 are not provided, a P-channel MOS transistor 71 and an N-channel MOS transistor 72 are added, and the output node N55 is coupled to the internal circuit block B1. Since the transistors 53, 58, and 61 and the inverter 64 are not provided, the regulator RA1 is always active.

The transistors 71 and 72 are coupled in series between the line of the external power supply voltage VCC and the line of the ground voltage VSS. The gates of the transistors 71 and 54 are coupled to the drain of the transistor 71. The gate of the transistor 72 receives the bias voltage Vn1. In the transistors 71 and 72, current of a level according to the bias voltage Vn1 flows, and the bias voltage Vp1 is generated at the gate of the transistor 71.

The differential amplifier 66 controls the transistor 55 so that the internal power supply voltage VDD1 coincides with the reference voltage VR1. As a result, the internal power supply voltage VDD1 is maintained at the reference voltage VR1. The Ahuja phase compensation circuit 67 for performing phase compensation on the regulator RA1 is configured by the transistors 54, 60, and 62 and the capacitor 65. Since each of the regulators RA2 and RA3 has the same configuration as that of the regulator RA1, its description will not be repeated.

Referring again to FIG. 1, the regulators RB1 to RB3 operate on the basis of the bias voltage Vn2 and generate the internal power supply voltages VDD1 to VDD3 on the basis of the reference voltage VR2. The regulators RB1 to RB3 are made active in the case where the control signal LP is at the "L" level as the activation level, and are made inactive in the case where the control signal LP is at the "H" level as the inactivation level. The current drive capability of the regulators RB1 to RB3 is higher than that of the regulators RA1 to RA3.

Figure 7:
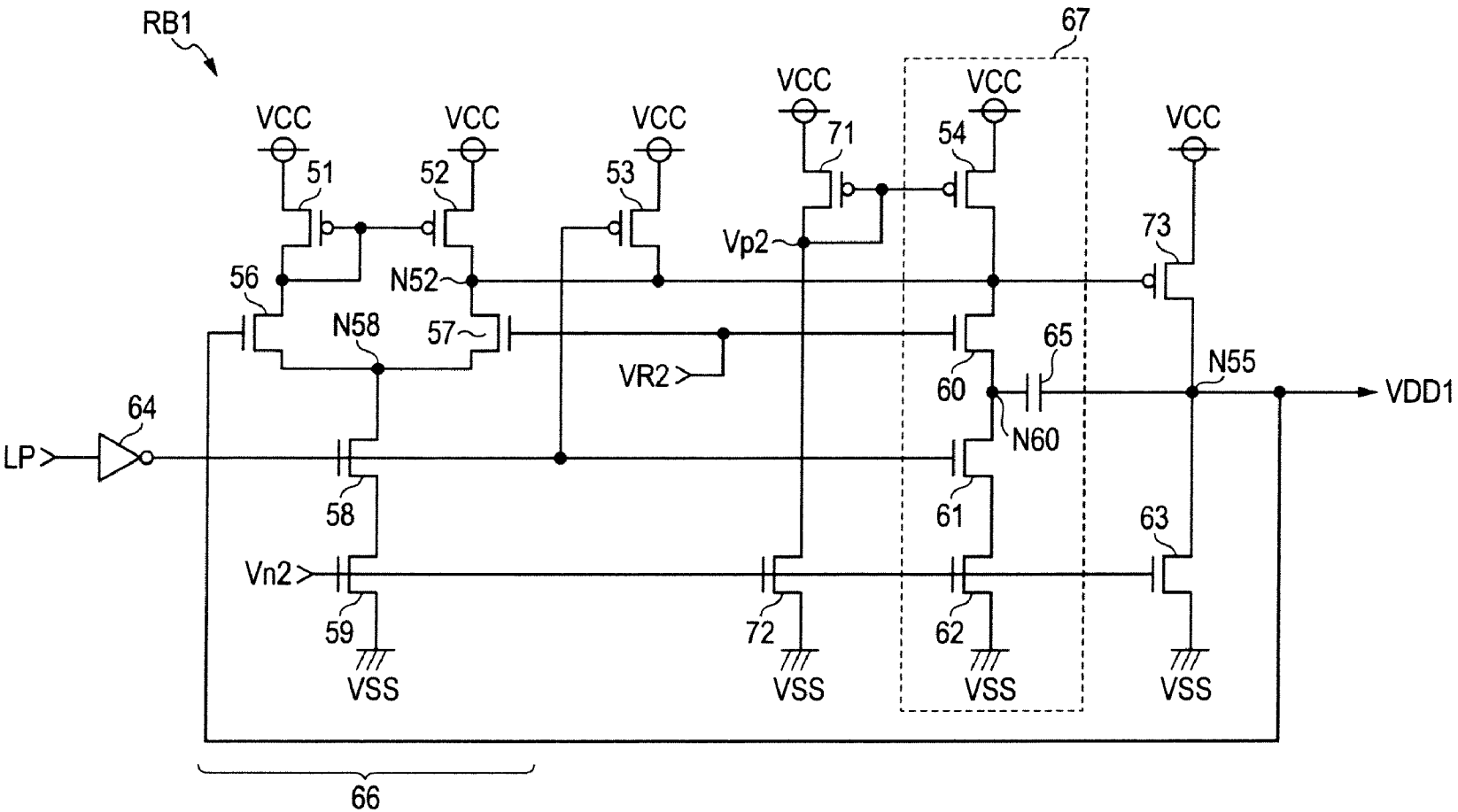
FIG. 7 is a circuit diagram showing the configuration of a regulator RB1 illustrated in FIG. 1.

FIG. 7 is a circuit diagram showing the configuration of the regulator RB1, which is compared to FIG. 5. Referring to FIG. 7, the regulator RB1 is different from the voltage buffer 6 of FIG. 5 with respect to the points that the reference voltage VR2 is introduced in place of the reference voltage VR1, the P-channel MOS transistor 71 and the N-channel MOS transistor 72 are added, the P-channel MOS transistor 55 is replaced with a P-channel MOS transistor 73, and the output node N55 is coupled to the internal circuit block B1.

The transistors 71 and 72 are coupled in series between the line of the external power supply voltage VCC and the line of the ground voltage VSS. The gates of the transistors 71 and 54 are coupled to the drain of the transistor 71. The gate of the transistor 72 receives the bias voltage Vn2. In the transistors 71 and 72, current of a level according to the bias voltage Vn2 flows, and the bias voltage Vp2 is generated at the gate of the transistor 71.

The current drive capability (size) of the transistor 73 is higher than that of the transistor 55. Therefore, the current drive capability of the regulator RB1 is higher than that of the regulator RA1.

In the case where the control signal LP is at the "L" level as the activation level, the differential amplifier 66 controls the transistor 73 so that the internal power supply voltage VDD1 coincides with the reference voltage VR2. As a result, the internal power supply voltage VDD1 is maintained at the reference voltage VR2. In the case where the control signal LP is at the "H" level as the inactivation level, the transistor 73 is fixed in the nonconductive state, and the output node N55 is coupled to the line of the ground voltage VSS via the transistor 63 as the constant current source. Since each of the regulators RB2 and RB3 has the same configuration as that of the regulator RB1, its description will not be repeated.

Referring again to FIG. 1, the internal circuit blocks B1 to B3 are driven by the internal power supply voltages VDD1 to VDD3, respectively. Each of the internal circuit blocks B1 to B3 executes the high-speed operation mode and the low-speed operation mode.

Next, the operation of the semiconductor chip will be briefly described. When the external power supply voltage VCC is supplied, the bias voltages Vp1 and Vn1 are generated by the current source 2, and the bias voltages Vp1 and Vn1 are given to the BGR voltage source 3, the reference voltage generating circuit 4, and the voltage buffer 6. The bias voltage Vn1 is further given to the current buffer 5 and the regulators RA1 to RA3.

Consequently, the constant voltage Vbgr is generated by the BGR voltage source 3, the reference voltage VR1 is generated by the reference voltage generating circuit 4, and the internal power supply voltages VDD1 to VDD3 are generated by the regulators RA1 to RA3, respectively. In the case where the control signal LP is at the "H" level as the inactivation level, the internal circuit blocks B1 to B3 are driven by the regulators RA1 to RA3 having small current drive capability, and execute the low-speed operation mode.

When the control signal LP is set to the "L" level as the activation level, the current buffer 5, the voltage buffer 6, and the regulators RB1 to RB3 are activated. The bias voltage Vn2 is generated by the current buffer 5, the reference voltage VR2 is generated by the voltage buffer 6, and the internal power supply voltages VDD1 to VDD3 are generated by the regulators RB1 to RB3, respectively. The internal circuit blocks B1 to B3 are driven by the regulators RA1 to RA3 having small current drive capability and the regulators RB1 to RB3 having large current drive capability and execute the high-speed operation mode.

In the embodiment, the current buffer 5 is provided between the current source 2 and the regulators RB1 to RB3, the voltage buffer 6 is provided between the reference voltage generating circuit 4 and the regulators RB1 to RB3 and, in the low-speed operation mode, the buffers 5 and 6 and the regulators RB1 to RB3 are made inactive. Therefore, noise in the reference voltage VR2 and the bias voltage Vn2 is suppressed, and the consumption current can be reduced.

Figure 8:
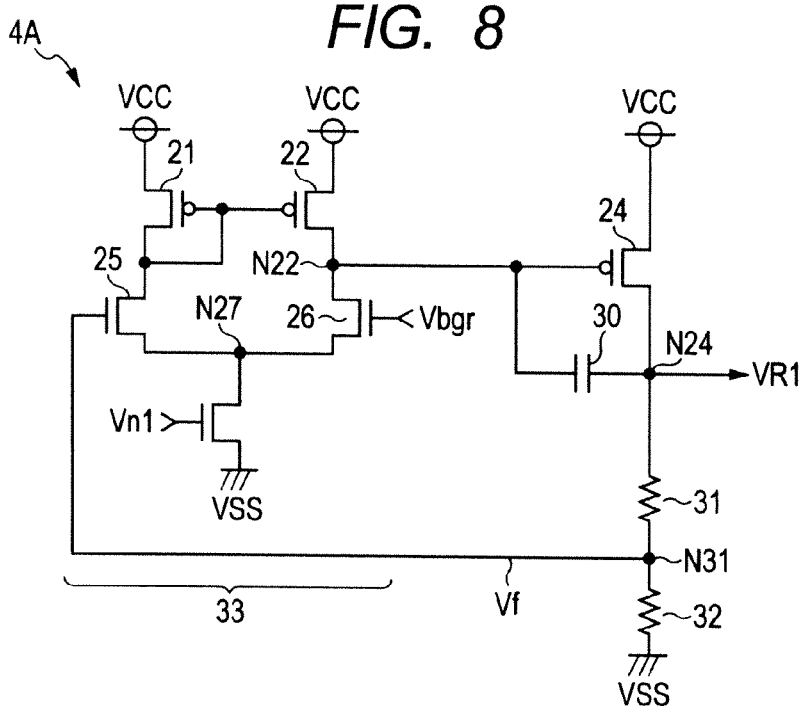
FIG. 8 is a circuit diagram showing a modification of the embodiment.

Various modifications of the embodiment will be described below. In a modification of FIG. 8, the reference voltage generating circuit 4 is replaced with a reference voltage generating circuit 4A. The reference voltage generating circuit 4A is obtained by removing the transistors 23, 28, and 29 from the reference voltage generating circuit 4. The capacitor 30 is coupled between the nodes N22 and N24. In the modification, the phase compensation is performed only by the capacitor 30 without using the bias voltage Vp1, so that the configuration can be simplified.

Figure 9:
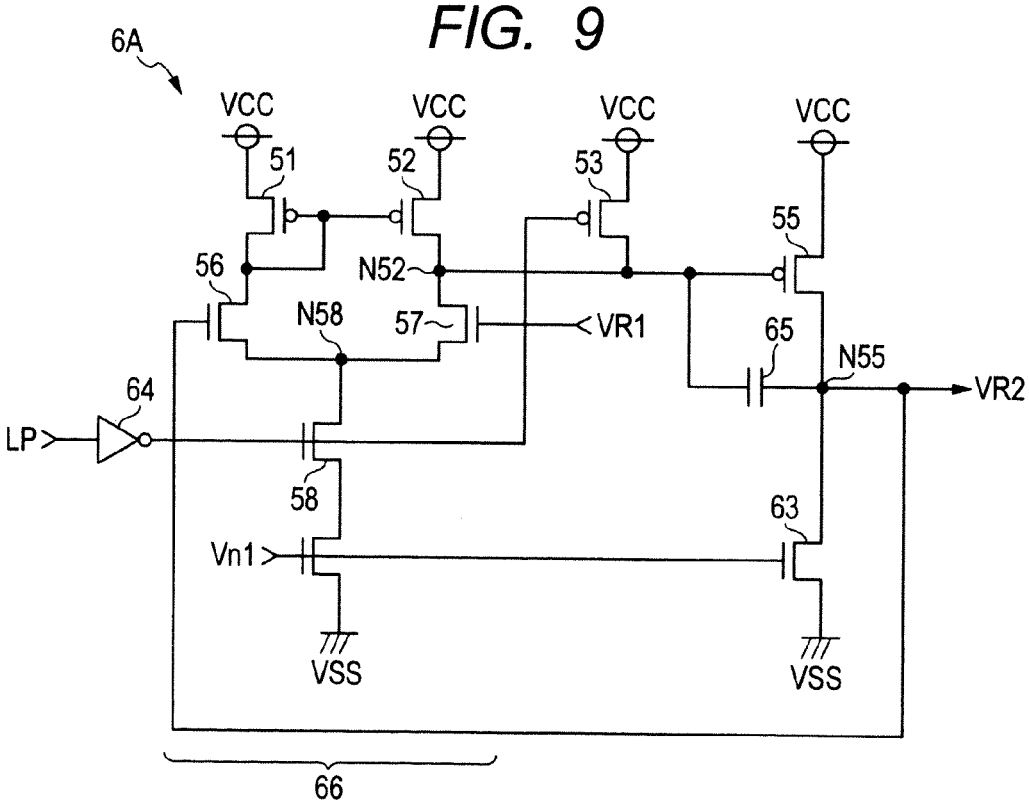
FIG. 9 is a circuit diagram showing another modification of the embodiment.

In a modification of FIG. 9, the voltage buffer 6 is replaced with a voltage buffer 6A. The voltage buffer 6A is obtained by removing the transistors 54 and 60 to 62 from the voltage buffer 6. The capacitor 65 is coupled between the nodes N52 and N55. In the modification, the phase compensation is performed only by the capacitor 65 without using the bias voltage Vp1, so that the configuration can be simplified.

Figure 10:
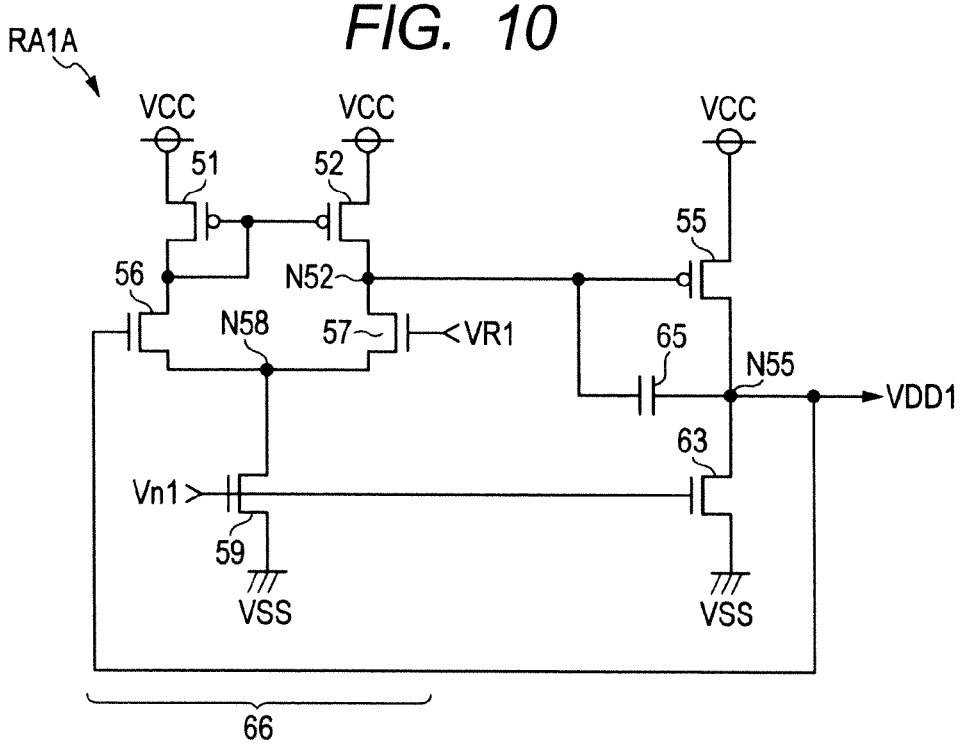
FIG. 10 is a circuit diagram showing further another modification of the embodiment.

In a modification of FIG. 10, the regulator RA1 is replaced with a regulator RA1A. The regulator RA1A is obtained by removing the transistors 54, 60, 62, 71, and 72 from the regulator RA1. The capacitor 65 is coupled between the nodes N52 and N55. The configuration of each of the regulators RA2 and RA3 is also changed like in the regulator RA1. In the modification, the phase compensation is performed only by the capacitor 65 without using the bias voltage Vp1, so that the configuration can be simplified.

Figure 11:
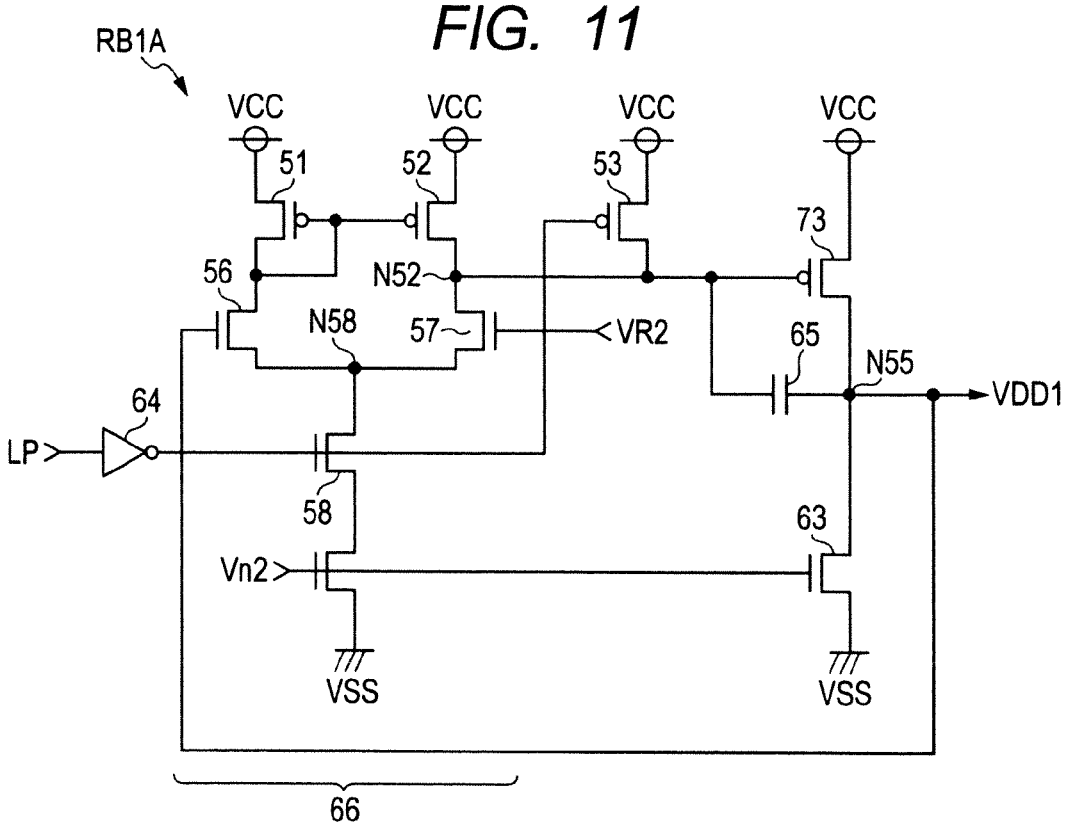
FIG. 11 is a circuit diagram showing further another modification of the embodiment.

In a modification of FIG. 11, the regulator RB1 is replaced with a regulator RB1A. The regulator RB1A is obtained by removing the transistors 54, 60 to 62, 71, and 72 from the regulator RB1. The capacitor 65 is coupled between the nodes N52 and N55. The configuration of each of the regulators RB2 and RB3 is also changed like in the regulator RB1. In the modification, the phase compensation is performed only by the capacitor 65 without using the bias voltage Vp1, so that the configuration can be simplified.

Figure 12:
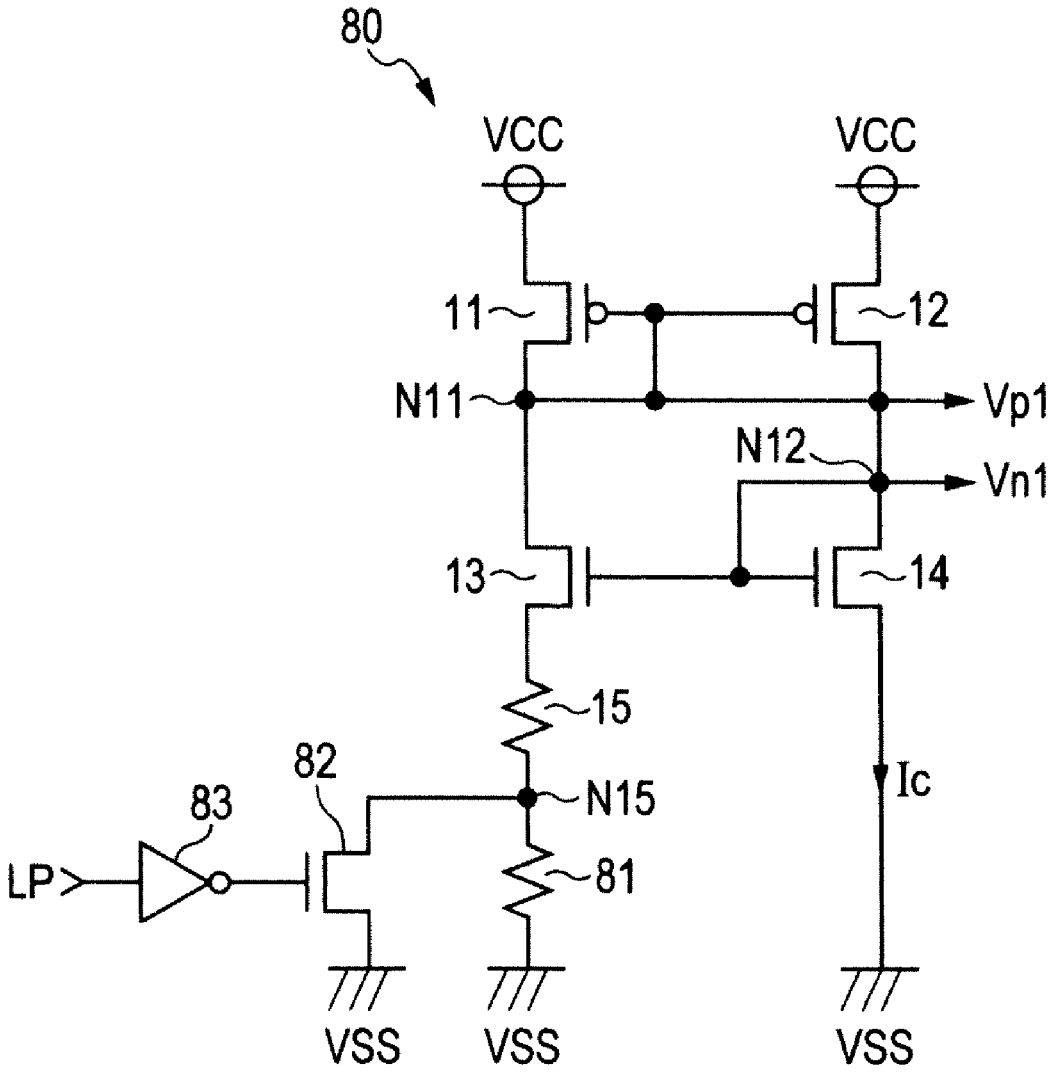
FIG. 12 is a circuit diagram showing further another modification of the embodiment.

In a modification of FIG. 12, the current source 2 is replaced with a current source 80. The current source 80 is obtained by adding a resistive element 81, an N-channel MOS transistor 82, and an inverter 83 to the current source 2. The resistive elements 15 and 81 are coupled between the source of the transistor 13 and the line of the ground voltage VSS. The transistor 82 is coupled between a node N15 between the resistive elements 15 and 81 and the line of the ground voltage VSS. The control signal LP is inverted by the inverter 83 and the resultant signal is given to the gate of the transistor 82.

In the case where the control signal LP is at the "L" level as the activation level, the transistor 82 is conducted, and the node N15 is grounded. In this case, the current source 80 has the same configuration as that of the current source 2. In the case where the control signal LP is at the "H" level as the inactivation level, the transistor 82 becomes nonconductive. In this case, the level of the constant current Ic decreases, the bias voltage Vn1 decreases, and the bias voltage Vp1 increases. As a result, the consumption current in the entire semiconductor chip decreases. In the modification, the consumption current in the first operation mode can be decreased more than that in the embodiment.

Figure 13:
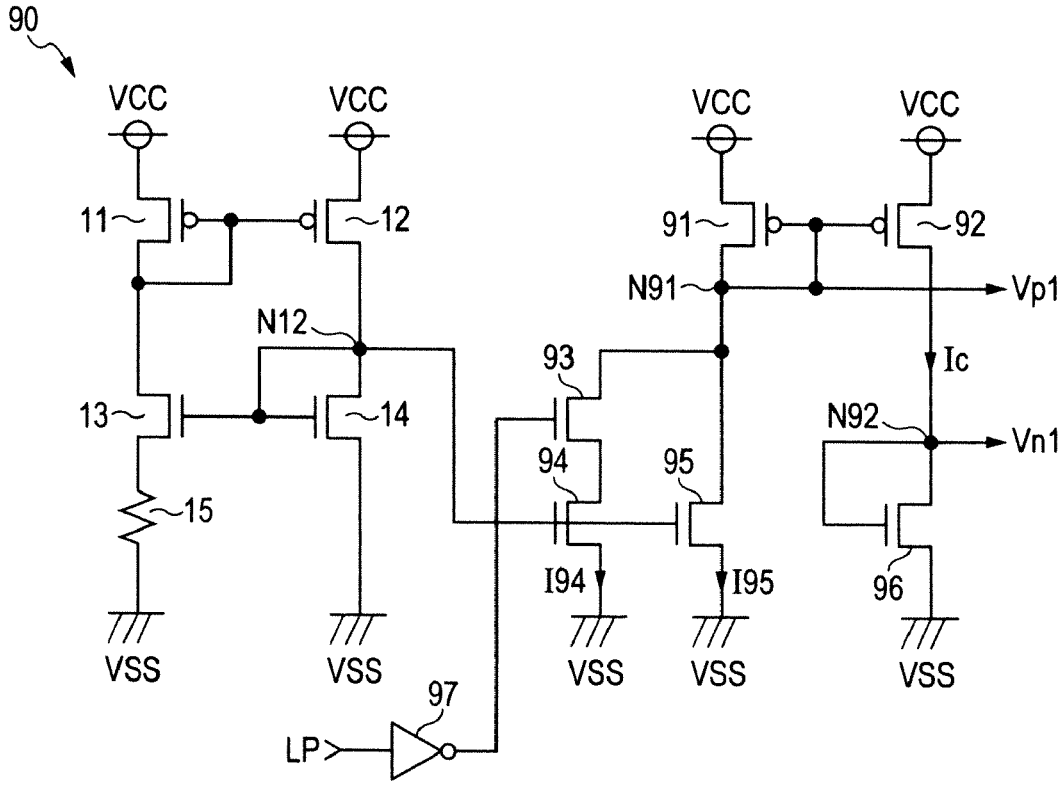
FIG. 13 is a circuit diagram showing further another modification of the embodiment.

In a modification of FIG. 13, the current source 2 is replaced with a current source 90. The current source 90 is obtained by adding P-channel MOS transistors 91 and 92, N-channel MOS transistors 93 to 96, and an inverter 97 to the current source 2. The transistors 91 and 95 are coupled in series between the line of the external power source voltage VCC and the line of the ground voltage VSS. The transistors 92 and 96 are coupled in series between the line of the external power source voltage VCC and the line of the ground voltage VSS. The gates of the transistors 91 and 92 are coupled to the drain (an output node N91) of the transistor 91. The gate of the transistor 96 is coupled to its train (an output node N92). Voltages which appear at the output nodes N91 and N92 become the bias voltages Vp1 and Vn1, respectively.

The transistors 93 and 94 are coupled in series between the output node N91 and the line of the ground voltage VSS. The gates of the transistors 94 and 95 are coupled to the node N12. The control signal LP is inverted by the inverter 97, and the resultant signal is given to the gate of the transistor 93.

In the case where the control signal LP is at the "L" level as the activation level, the transistor 93 is conducted, and currents I94 and I95 of a level according to the voltage at the node N12 flow in the transistors 94 and 95. To each of the transistors 91, 92, and 96, the constant current Ic of a level according to current of the sum of the currents I94 and I95 flowing in the transistors 94 and 95 flows.

In the case where the control signal LP is at the "H" level as the inactivation level, the transistor 93 becomes nonconductive, and the current I95 of a level according to the voltage at the node N12 flows in the transistor 95. To each of the transistors 91, 92, and 96, the current of the level according to the current I95 flowing in the transistor 95 flows. In this case, the level of the constant current Ic decreases, the bias voltage Vn1 decreases, and the bias voltage Vp1 increases. As a result, the consumption current in the entire semiconductor chip decreases. Also in the modification, the consumption current in the low-speed operation mode can be decreased more than that in the embodiment.

It is to be considered that the embodiments disclosed are illustrative and not restrictive in all of the aspects. The scope of the present invention is not defined by the scope of the claims rather than the foregoing description. All changes that fall within meets and bounds of the claims are intended to be embraced.

What is claimed is:

1. A semiconductor chip having a first operation mode in which first current is consumed and a second operation mode in which second current larger than the first current is consumed, comprising:

a reference voltage generating circuit for generating a first reference voltage;

a first regulator having first current drive capability and generating a power supply voltage on the basis of the first reference voltage;

a voltage buffer for generating a second reference voltage of a level according to the first reference voltage;

a second regulator having second current drive capability higher than the first current drive capability and generating the power supply voltage on the basis of the second reference voltage; and an internal circuit which is driven by the power supply voltage generated by the first and second regulators and executes the first and second operation modes, wherein the first regulator and the voltage buffer are provided near the reference voltage generating circuit, wherein the second regulator is provided near the internal circuit, and wherein the voltage buffer and the second regulator are made inactive in the first operation mode.

2. The semiconductor chip according to claim 1, further comprising:

a current source which generates a constant current and outputs first and second bias voltages for passing a current of a level according to the constant current to transistors of first and second conduction types; and a voltage source which generates constant voltage on the basis of the first and second bias voltages, wherein the reference voltage generating circuit generates the first reference voltage on the basis of the constant voltage, and wherein the current source and the voltage source are provided near the reference voltage generating circuit.

3. The semiconductor chip according to claim 2, wherein the reference voltage generating circuit operates on the basis of at least one of the first and second bias voltages.

4. The semiconductor chip according to claim 3, further comprising a current buffer which generates a third bias voltage of a level according to the first bias voltage, wherein the first and second regulators operate on the basis of the first and third bias voltages, respectively, and wherein the current buffer is provided near the reference voltage generating circuit and is made inactive in the first operation mode.

5. The semiconductor chip according to claim 4, wherein the first regulator generates a fourth bias voltage for passing a current of a level according to the constant current to the transistor of the second conduction type on the basis of the first bias voltage and operates on the basis of the first and fourth bias voltages.

6. The semiconductor chip according to claim 5, wherein the second regulator generates a fifth bias voltage for passing a current of a level according to the constant current to the transistor of the second conduction type on the basis of the third bias voltage and operates on the basis of the third and fifth bias voltages.

7. The semiconductor chip according to claim 6, wherein the current source generates the constant current of a first level in the first operation mode and generates the constant current of a second level higher than the first level in the second operation mode.

* * * * *